US005270724A

United States Patent [19]

Ajioka

[11] Patent Number: 5,270,724

[45] Date of Patent: Dec. 14, 1993

[54] MULTIFREQUENCY PHASED ARRAY APERTURE

[75] Inventor: James S. Ajioka, Fullerton, Calif.

[73] Assignee: Hughes Aircraft Company, Los Angeles, Calif.

[21] Appl. No.: 683,057

[22] Filed: Apr. 4, 1991

[51] Int. Cl.[5] ..... H01Q 21/00; H01Q 13/00

[52] U.S. Cl. ..... 343/725; 343/771

[58] Field of Search ..... 343/725, 767, 776, 770, 343/771, 772; 333/26, 248

[56] References Cited

U.S. PATENT DOCUMENTS

| | | | |
|---|---|---|---|
| 4,141,012 | 2/1979 | Hockham et al. | 343/725 |
| 4,243,990 | 1/1981 | Nemit et al. | 343/771 |
| 4,782,345 | 11/1988 | Landt | 343/725 |
| 4,839,662 | 6/1989 | Wood | 343/771 |
| 4,839,663 | 6/1989 | Kurtz | 343/771 |
| 5,023,623 | 6/1991 | Kreinheder et al. | 343/770 |
| 5,028,891 | 7/1991 | Lagerlöf | 343/771 |

*Primary Examiner*—Michael C. Wimer
*Assistant Examiner*—Tan Ho
*Attorney, Agent, or Firm*—Wanda K. Denson-Low

[57] ABSTRACT

A shared antenna aperture has two or more sets of interleaved antenna elements. Open-ended waveguides are used for the elements of the higher frequency antenna array and are selectively interconnected to form the elements of the other sharing antenna arrays. Plates are used to short walls of adjacent waveguides to form notch antennas. Coaxial feeds are used to excite the notches at a lower frequency than the waveguides. In one embodiment, the notch antennas formed of two interconnected waveguides operate at half the frequency of the waveguides. To form a third sharing antenna, four adjacent waveguides are interconnected to form notch antenna elements and these notches are excited at an even lower frequency.

14 Claims, 2 Drawing Sheets

MULTIFREQUENCY PHASED ARRAY APERTURE

BACKGROUND

The invention is related generally to multifrequency band apertures, and more particularly, to apertures shared by two or more antennas, one or more of which is a phased array.

Multifrequency radiation and reception applications frequently are associated with space, weight, and mutual interference limitations. For example, applications on aircraft, spacecraft, ships at sea and mobile land platforms all typically have severe size and weight restrictions. It is typically impractical to have multiple antennas with multiple apertures in these applications. A shared aperture, wherein multiple antennas share a common aperture area, is preferred.

One type of shared aperture is the dual dipole aperture. Dipole elements for both frequency bands are used with a common ground plane. To minimize mutual coupling, the dipoles are orthogonally polarized. Because of the physical requirements of the dipoles, one set must be located behind the other set and must therefore, "see through" the more forward set. Typically, the higher frequency set of dipoles is disposed behind the lower frequency set. This arrangement results in pattern degradation for the higher frequency set because energy scatters off and couples to the interfering set of feed lines to the lower frequency dipoles. Also, because the spacing of the lower frequency set of dipoles is greater than one-half wavelength of the higher frequency set, impedance mismatch exists for the higher frequency elements and radiation in unwanted directions occurs. This radiation is commonly referred to as grating lobes or Bragg reflections and additionally results in a loss of power in the desired beam.

Combination waveguide/dipole shared apertures also exist with the waveguide containing the higher frequency energy. The dipoles are place in front of the waveguides with a similar result as described above for the two dipole arrangement. The lower frequency dipoles interfere with the energy of the higher frequency waveguides and grating lobes result.

In one prior technique where a single set of broadband elements is used for all frequency bands, the broadband elements are spaced at half-wavelength intervals at the highest frequency band. A multiplexer is used for each radiating element to separate out the various frequency bands. Because the elements are half-wavelength spaced for the highest frequency band, there are many more elements per wavelength for the lower frequency bands. It would be wasteful to use a phase shifter per element at the lower frequencies because only one phase shifter per one-half wavelength is required. Thus the outputs of the multiplexers should be combined in groups before the phase shifters to result in one phase shifter per one-half wavelength. This leads to a complex feed network, higher weight and larger size and is impractical for many applications.

Hence, those skilled in the art have recognized the need for a shared antenna aperture in which two or more sets of energy radiating elements for radiating different frequency bands may coexist in the same aperture without interfering with one another, in which grating lobes are minimized and which are more easily constructed than prior art apertures. The present invention meets these needs.

SUMMARY OF THE INVENTION

In accordance with the principles of the invention, a shared aperture antenna is provided in which two or more sets of antenna elements may coexist, none of which must "see through" the other or others. The elements of the plurality of antenna arrays in the aperture are interleaved and have phase centers on a common plane and share a common physical structure to provide a compact and efficient aperture design.

In accordance with one aspect of the invention, elements of one antenna are selectively coupled together to form the elements of the other or others of the sharing antennas. In one embodiment, an array of open-ended waveguides is used to radiate the energy at the highest frequency and forms one of the antennas in the aperture. Short circuits are place between selected waveguides to form notches. A separate feed, such as a coaxial cable, is used to excite this notch to form a notch antenna by coupling one electrical conductor of the feed to one waveguide wall and the other conductor of the feed to the other waveguide wall of the notch. The coupled waveguides then act as "wings" of a notch element or fat dipole. The notch antenna performs in a manner similar to a frame dipole. Because these notch antennas use two waveguides to form the notch wings, the notch antenna array operates at a lower frequency than the antenna formed of the waveguides alone.

In another embodiment, a third antenna array may be formed by electrically shorting selected waveguides together to form larger wings for notch antennas for even lower frequency operation. In this embodiment, the wings would be two waveguides long for operation at a much lower frequency than the open-ended waveguides' operating frequency.

In all antennas in the aperture, the individual elements are spaced from each other by approximately a one-half wavelength of the frequency band radiated by that particular antenna. Chokes may be disposed between adjacent waveguides of the notch antennas to increase isolation.

The antennas of the aperture are interleaved with one another so that all antennas share the same aperture and physical structure. Additionally, all antennas are located in a common plane and all have phase centers on this common plane, thus no antenna has to see through another antenna.

Other aspects and advantages of the invention will become apparent from the following detailed description and accompanying drawings, illustrating by way of example the features of the invention.

DETAILED DESCRIPTION OF THE PREFERRED EMBODIMENT

Figure 1:
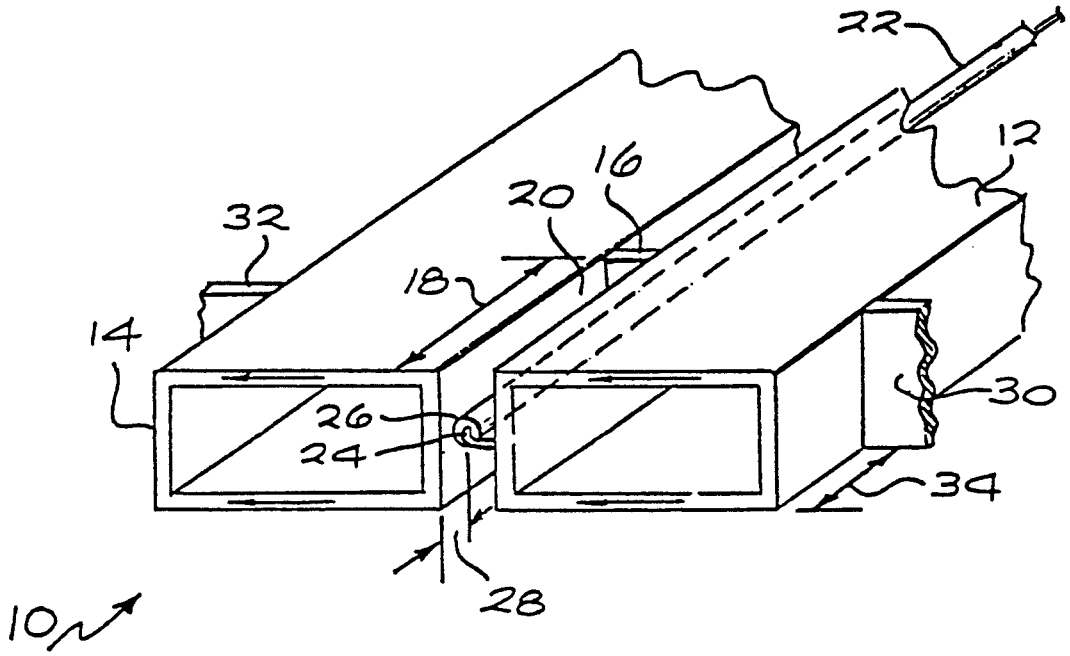
FIG. 1 is a perspective view of a pair of open-ended waveguides coupled together with a feed to form a notch antenna in accordance with an aspect of the invention.

Referring now to the drawings with more particularity, wherein like reference numerals designate like or corresponding elements among the several views, there is shown in FIG. 1 a shared aperture antenna 10 in which a pair of waveguides 12 and 14 is used to form a single notch antenna. Each respective waveguide 12 and 14 is used to radiate signals of a first, high-frequency band and each has a feed which may be of a conventional nature (not shown). In the embodiment of FIG. 1, the open ends of both waveguides 12 and 14 are located in a common plane. Additionally, the waveguides 12 and 14 are used to form a second antenna which operates at a lower frequency.

A plate 16 resulting in an electrical short is attached between the two waveguides 12 and 14 at a position which is a selected distance 18 from the open ends of the waveguides. The position 18 may nominally be one-quarter wavelength of the frequency to be radiated by the notch antenna element. The use of this shorting plate 16 disposed at a particular position in relation to the open ends of the waveguides establishes a "notch" 20 between the waveguides. A feed 22 is used to excite a voltage between the narrow walls of the two adjacent waveguides 12 and 14 of this notch 20. As shown in FIG. 1, the feed 22 comprises a coaxial line with the center conductor 24 attached to the wall of one waveguide 12 and the outer conductor 26 attached to the wall of the other waveguide 14. This arrangement forms a balun type feed from the unbalanced coaxial line 22 to the balanced notch 20.

The use of the shorting plate 16 between the two adjacent waveguides 12 and 14 and a feed for exciting this three-sided space forms a notch-type antenna. This notch antenna is used to radiate energy of a second, lower frequency band than that radiated by the waveguides alone. Locating the excitation feed 22 in the notch 20 results in the lips of the open-ended waveguides 12 and 14 radiating the RF current flow as shown by the arrows in FIG. 1. Thus, the current distribution is similar to that of a frame dipole.

Figure 2:
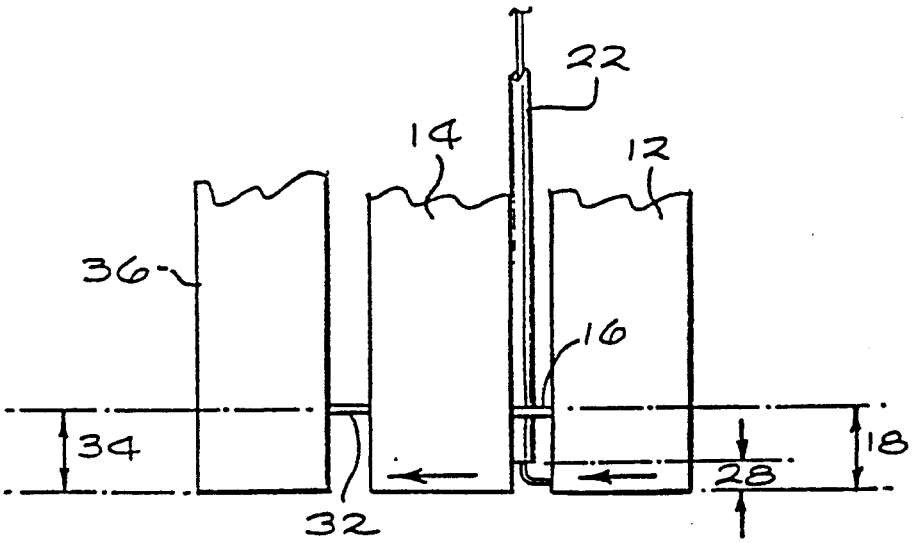
FIG. 2 is a top view of three waveguides showing the RF current flow through the coupled waveguides forming a notch antenna element or frame dipole and showing a choke formed with a third waveguide.

Referring now to both FIGS. 1 and 2, the shorting plate 16 is located a particular distance 18 back from the open ends of the waveguides 12 and 14 but is adjusted for the desired response. The distance 28 from the open ends of the waveguides to the attachment point of the outer conductor 26 of the feed 22 to the waveguide wall 14 also may be adjusted for impedance matching and desired response. The distance between the open ends of the waveguides and the attachment point of the center conductor 24 of the feed 22 may be similarly adjusted.

Although shown as a coaxial cable in the figures, notch antenna feed 22 may take other forms. In one embodiment, the outer conductor 26 of the notch feed 22 is soldered, brazed or otherwise connected continuously along the wall of one waveguide 14 and the center conductor 24 is soldered to the wall of the other waveguide 12. Additionally, the feed 22 is disposed through an opening made in the shorting plate 16. While this arrangement results in a more compact array, other placements of the feed 22 are possible.

Cross coupling of the respective energies of the two antennas may be greatly reduced in an aperture in accordance with the invention. The first and second frequency bands may be orthogonally polarized from each other. As one example, the waveguides which radiate the first, higher frequency band may be vertically polarized while the notch antenna which radiates the second, lower frequency band may be horizontally polarized. In FIG. 1, the arrows in the broad walls represent the horizontal polarization of the notch antenna while the field of the waveguide antenna itself would be parallel to the short waveguide walls. Therefore, the notch elements will not receive energy radiated by the waveguides 12 and 14. Additionally, the notch antenna array comprising the notch elements is used to radiate energy at a frequency below the cutoff frequency of the waveguide element antenna array, thus no cross-coupling of the second frequency band into the waveguides occurs. In one embodiment, a nominal two-to-one separation between the frequency bands was used.

Additionally shown in FIGS. 1 and 2 are chokes 30 and 32. Chokes 30 and 32 may be implemented by plates shorting adjacent waveguides and located so as to create a one-quarter wavelength slot or notch. The distance 34 of the shorting plate from the open waveguide end is one-quarter wavelength of the frequency of operation of the notch antenna. In FIG. 2, the shorting plate creating choke 32 is shown shorting waveguide 14 and waveguide 36. The distance 34 of the shorting plates to form chokes may differ from the distance 18 of the shorting plate to form the excited notch 20. As discussed above, the distance 18 to form excited notch 20 may be adjusted to achieve desired impedance matching requirements while the choke depth is adjusted for best isolation.

Figure 3:
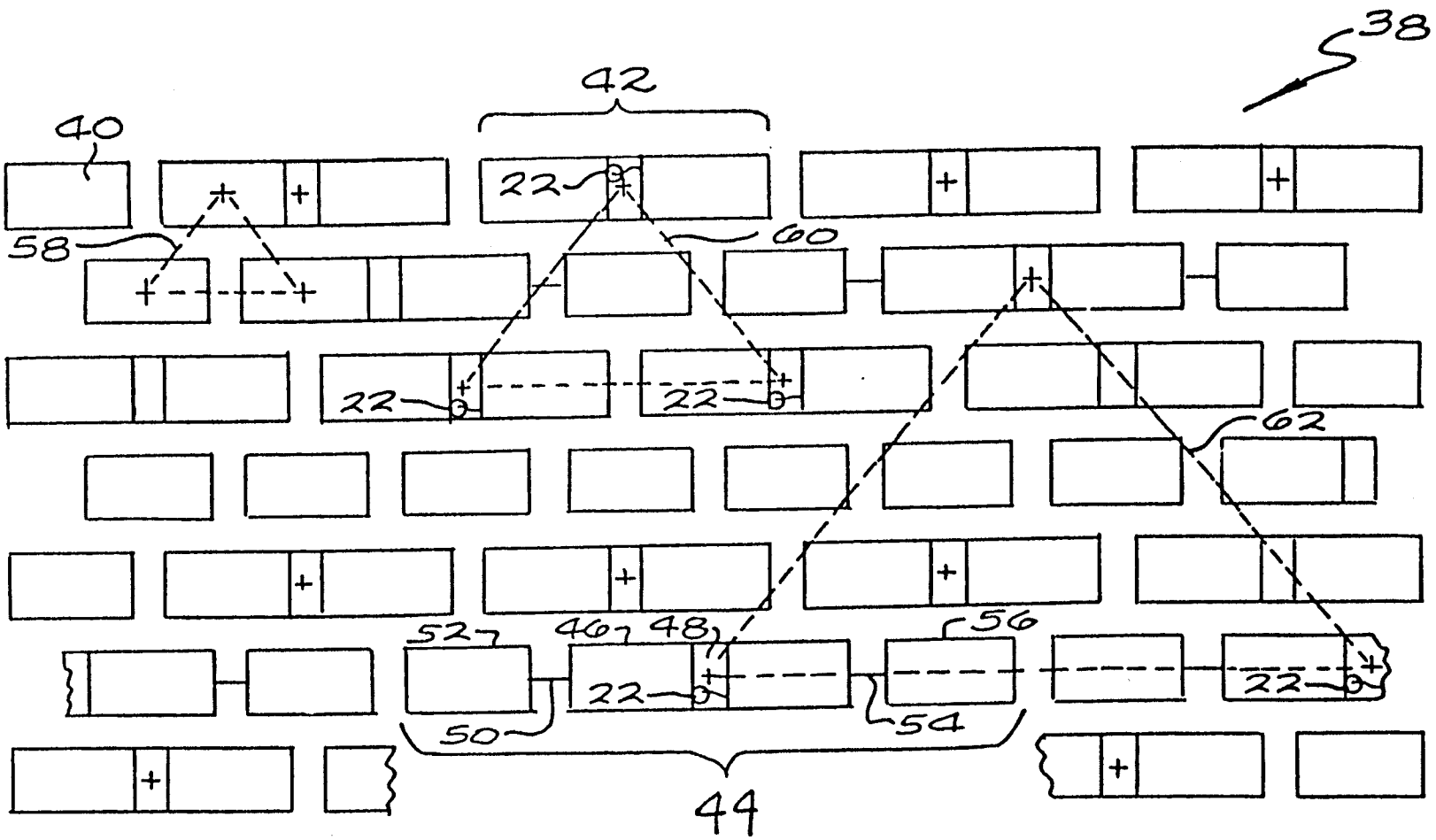
FIG. 3 is an end-on view of an array of the waveguides of FIG. 1 forming a single aperture in which the waveguides are coupled together in various ways to form three antennas sharing the common aperture in accordance with the principles of the invention.

Referring now to FIG. 3, an aperture 38 comprising three antennas is shown. The first antenna comprises an array of open-ended waveguides 40. The second and third antennas are formed by interconnecting these waveguides as described below. All three antennas coexist in the same aperture 38 and share the same phase center and physical structure. The open ends of the waveguides 40 are located in a common plane and are the building blocks for all three antennas. The numeral 40 is shown pointing to only one waveguide in FIG. 3 to preserve clarity but it is meant to indicate all waveguides in the aperture 38.

A first antenna is formed by the array of waveguides 40 alone which are used to radiate in a first frequency band. The waveguides are spaced at approximately one-half wavelength apart for the first frequency band and have a feed system for each waveguide (not shown) which may be conventional.

A second antenna is formed in the aperture 38 by coupling two adjacent waveguides 40 together to form a notch antenna element 42 in the manner described above and shown in FIGS. 1 and 2. Each notch antenna element 42 in the second antenna requires two adjacent high frequency waveguides 40 to make one notch antenna element 42. While the numeral 42 is directed to only one notch antenna element in the figure, it is means to include all such elements. It has been restricted to pointing at only one to retain clarity in the figure. Likewise, the feed device 22 is labeled by numeral 22 in only select cases in the figure to preserve clarity but each notch antenna element is meant to have a feed. The spacing between notch elements 42 is approximately twice that of the waveguide elements 40. Because the wavelength of the frequency band radiated by the notch antenna elements 42 of the second antenna is approximately twice that of the high frequency band radiated by the individual waveguide elements 40, the notch antenna element 42 spacing is the same in wavelengths as in the first antenna which is desirable. Thus, an aperture in accordance with this arrangement may radiate two frequency bands which are an octave apart.

In FIG. 3, a third antenna is formed in the aperture 38. By creating a notch antenna element and then shorting the two waveguides together on either side of the notch antenna element to the notch element wings, the wings of the notch may be lengthened to thereby efficiently radiate energy at a third and even lower frequency band. Such an arrangement results in a third antenna element 44. As is shown in FIG. 3, the third antenna element 44 comprises a notch antenna element 46 formed as described above and shown in FIGS. 1 and 2. The notch antenna element 46 of this third antenna will differ from the notch antenna element 42 of the second antenna in that the shorting plate 48 will likely be located further back from the open ends of the waveguide to form a deeper notch so that the lower frequency energy can be more efficiently radiated. An electrical conductor 50 is disposed between one waveguide used to form the notch and an adjacent waveguide 52. A second electrical conductor 54 is disposed between the other waveguide used to form the notch and another adjacent waveguide 56. Thus the wings of the notched antenna element 44 of the third antenna are more than twice as long as the wings of the notch antenna element 42 of the second antenna and a third, lower frequency band may be radiated. The spacing between notch elements 44 is also approximately one-half of a wavelength of the energy radiated by the third antenna which is desirable.

Although not shown in FIG. 3, chokes may be disposed between adjacent notch antenna elements for purposes of isolation. The distance between the plate forming the bottom of the choke and the open end of the waveguide is determined by the frequency of the antenna and will likely be deeper for the third antenna than the corresponding distance for the second antenna due to the difference in frequencies radiated.

In one embodiment, the frequency radiated by the second antenna was one-half that of the first antenna and the frequency radiated by the third antenna was one-fourth that of the first antenna. In the embodiment of an aperture shown in FIG. 3, the three antennas are organized in triangular lattice structures for scanning in all planes. Thus, the open-ended waveguide 40 antenna is organized in relatively small triangles 58, the second antenna of notched elements 42 is organized into larger triangles 60, and the third antenna of the larger notched elements 44 is organized into even larger triangles 62. The spacing of the feed points of the second antenna is nominally twice that of the first antenna and the spacing of the feed points of the third antenna is nominally four times that of the first antenna.

Thus the waveguides 40 form a basic building block for all antenna arrays of the aperture 38. By selectively coupling the waveguides together to form notch antennas, the waveguides perform two functions.

Although shown in FIG. 3 as a three antenna aperture, an aperture in accordance with one aspect of the invention may take the form of a two antenna aperture. In such case, the open-ended waveguides would form one antenna operating at a relatively high frequency band and a second antenna may be included in the aperture by forming notched elements as shown in FIGS. 1 and 2 above. Because only two antennas exist in the aperture, the plate 16 forming the notch in each notch antenna element may comprise a continuous plate through which the open-ended waveguides extend. The plate could also then form a ground plane.

Thus, in accordance with the invention, two or more antennas are interleaved in a shared aperture. The antennas share a common aperture and all are disposed in a common plane with phase centers in that plane so that interference is avoided. Because of this arrangement, grating lobes are reduced.

Although the term "radiating" is used in the specification and claims, this term is not meant to be restrictive. The structure described herein is meant to be subject to the theory of reciprocity and the term "radiated" is meant to also include the function of receiving.

Although preferred and alternative embodiments of the invention have been described and illustrated, the invention is susceptible to numerous modifications and adaptations within the ability of those skilled in the art and without the exercise of inventive faculty. Thus, it should be understood that various changes in form, detail and usage of the present invention may be made without departing from the spirit and scope of the invention.

What is claimed is:

1. A dual frequency antenna having a common aperture for each frequency comprising:

a pair of similar waveguides, each said waveguide having a cross-sectional area selected to radiate electromagnetic energy of a first frequency band, said waveguides being disposed in a parallel, side-by-side, separated relationship and spaced from one another by approximately one-half wavelength of said first frequency band, each said waveguide having an open end lying substantially in a common plane;

an electrical shorting conductor disposed between and interconnecting said waveguides, said electrical conductor and said waveguides forming a notch antenna, wherein said conductor is positioned a selected distance from said open ends such that said notch antenna radiates electromagnetic energy of a second frequency band, said second frequency band being lower than said first frequency band.

2. A dual frequency antenna as recited in claim 1 further comprising:

means for feeding electromagnetic energy of said first frequency band to said waveguides; and means for feeding electromagnetic energy of said second frequency band to said notch antenna positioned between the side-by-side walls of said pair of waveguides.

3. A dual frequency antenna as recited in claim 2 further comprising a choke element coupled between adjacent pairs of waveguides, said choke elements coupled between adjacent outside walls of said waveguides.

4. A dual frequency antenna as recited in claim 2 wherein said means for feeding electromagnetic energy to said notch antenna comprises a coaxial feed line having its center conductor coupled to one of said side-by-side walls and its outer conductor coupled to the other of said side-by-side walls.

5. A dual frequency antenna as recited in claim 4 further comprising a choke element coupled between adjacent pairs of waveguides, said choke elements coupled between adjacent outside walls of said waveguides.

6. A dual frequency antenna as recited in claim 1 including a plurality of pairs of said similar waveguides, said plurality of pairs disposed in an array having an aperture lying in said common plane.

7. A dual frequency antenna as recited in claim 6 further comprising:

means for feeding electromagnetic energy of said frequency to said waveguides; and means for feeding electromagnetic energy of said second frequency band to said notch antenna positioned between the side-by-side walls of each of said pairs of waveguides.

8. A dual frequency antenna as recited in claim 7 further comprising a choke element coupled between adjacent pairs of waveguides, said choke elements coupled between adjacent outside walls of said waveguides.

9. A dual frequency antenna as recited in claim 7 wherein said means for feeding electromagnetic energy to said notch antenna of each of said pairs of waveguides comprises a coaxial feed line having its center conductor coupled to one of said side-by-side walls and its outer conductor coupled to the other of said side-by-side walls.

10. A dual frequency antenna as recited in claim 9 further comprising a choke element coupled between adjacent pairs of waveguides, said choke elements coupled between adjacent outside walls of said waveguides.

11. A multiple frequency antenna having a common aperture for each frequency comprising:

a plurality of pairs of similar waveguides disposed in a row, each said waveguide having a cross-sectional area selected to radiate electromagnetic energy of a first frequency band, said waveguides in said pairs being disposed in a parallel, side-by-side, separated relationship and spaced from one another by approximately one-half wavelength of said first frequency band, each said waveguide having an open end lying substantially in a common plane;

a first electrical shorting conductor disposed between and interconnecting first and second waveguides in selected pairs, said first electrical conductor and said first and second waveguides forming a first notch antenna, wherein said first conductor is positioned a first selected distance from said open ends such that said first notch antenna radiates electromagnetic energy when fed by a signal of a second frequency band, said second frequency band being lower than said first frequency band;

said pairs of waveguides being disposed in parallel side-by-side separated relationship;

a second electrical shorting conductor disposed between and interconnecting third and fourth waveguides in selected other pairs, said second electrical conductor and said third and fourth waveguides forming a second notch antenna, wherein said second conductor is positioned a second selected distance from said open ends such that said second notch antenna radiates electromagnetic energy when fed by a signal of a third frequency band, said third frequency being lower than said second frequency;

a third electrical conductor connecting a waveguide adjacent the third waveguide to said third waveguide; and a fourth electrical conductor connecting a waveguide adjacent the fourth waveguide to said fourth waveguide.

12. A multiple frequency antenna as recited in claim 11 comprising:

means for feeding electromagnetic energy of said first frequency band to said waveguides;

means for feeding electromagnetic energy of said second frequency band between the side-by-side walls of each of said selected pairs of waveguides; and means for feeding electromagnetic energy of said third frequency between the side-by-side walls of said selected other pairs of waveguides.

13. A multiple frequency antenna as recited in claim 12 wherein said means for feeding electromagnetic energy to said first and second antennas comprises a coaxial feed line having its center conductor coupled to one of said side-by-side walls and its outer conductor coupled to the other of said side-by-side walls.

14. A multiple frequency antenna as recited in claim 11 further comprising a plurality of rows of said pairs of waveguides.

* * * * *